US010816260B2

(12) United States Patent
Fennelly

(10) Patent No.: US 10,816,260 B2
(45) Date of Patent: Oct. 27, 2020

(54) USE OF AN AIR-CLEANING BLOWER TO KEEP CONDENSER COILS CLEAN

(71) Applicant: Richard P. Fennelly, Cortlandt Manor, NY (US)

(72) Inventor: Richard P. Fennelly, Cortlandt Manor, NY (US)

(73) Assignee: CoilPod LLC, Yorktown Heights, NY (US)

( * ) Notice: Subject to any disclaimer, the term of this patent is extended or adjusted under 35 U.S.C. 154(b) by 0 days.

(21) Appl. No.: 15/530,931

(22) Filed: Mar. 24, 2017

(65) Prior Publication Data

US 2018/0156525 A1 Jun. 7, 2018

Related U.S. Application Data

(60) Provisional application No. 62/390,915, filed on Apr. 14, 2016, provisional application No. 62/390,318, filed on Mar. 25, 2016.

(51) Int. Cl.

| | |
|---|---|
| ***F25D 23/00*** | (2006.01) |
| ***F25B 47/00*** | (2006.01) |
| ***F25B 39/04*** | (2006.01) |

(52) U.S. Cl.

CPC ..... *F25D 23/003* (2013.01); *F25B 47/00* (2013.01); *F25B 39/04* (2013.01)

(58) Field of Classification Search

CPC ..... F25D 23/003; F25D 2323/0024; F25D 2400/22; F25B 47/00; F25B 39/04

USPC ..... 62/89, 100, 125, 303

See application file for complete search history.

(56) References Cited

U.S. PATENT DOCUMENTS 1,967,019 A * 7/1934 Buchanan ..... F25B 49/027 62/183
2,525,462 A * 10/1950 Shell ..... F25B 47/00 318/54
2,665,560 A * 1/1954 Hubbard ..... F24F 5/001 62/197
2,811,840 A * 11/1957 Thompson ..... F25D 23/003 126/299 R (Continued)

OTHER PUBLICATIONS

Aero Conditioner Co., http:www.Picture.com/user/aeroconditioner/3860328360, Sep. 19, 2016.

(Continued)

*Primary Examiner* — Ljiljana V. Ciric
(74) *Attorney, Agent, or Firm* — Richard P. Fennelly

(57) ABSTRACT

A refrigeration apparatus including an enclosure with an opening and condenser coils disposed within the enclosure, a cover plate dimensioned to fit over the opening, and with an air-cleaning blower apparatus placed over an orifice in the cover plate. The orifice in the cover plate is in communication with the interior of the enclosure holding the condenser coils, with the air-cleaning blower apparatus positioned in the incoming air stream to remove contaminants from the incoming air stream before the incoming air stream contacts the condenser coils. The cover plate may also have ports for introducing compressed air into the enclosure and for applying a vacuum to the enclosure, as well as an indicator for signaling the need for cleaning the condenser coils.

5 Claims, 2 Drawing Sheets

(56) References Cited

U.S. PATENT DOCUMENTS 3,021,686 A * 2/1962 Alt ..... F25C 1/12 62/132
3,022,639 A * 2/1962 Brown ..... F25B 47/022 62/155
3,218,819 A * 11/1965 Crotser ..... F25B 47/022 62/155
3,344,854 A * 10/1967 Boyajian ..... F01P 11/06 165/119
3,518,841 A * 7/1970 West, Jr. ..... F25D 17/065 62/153
3,569,806 A * 3/1971 Brailsford ..... H02K 29/10 318/400.4
3,729,773 A * 5/1973 Dillon ..... A22C 21/00 426/524
3,736,768 A * 6/1973 Harbour ..... F25D 23/003 62/289
3,787,114 A * 1/1974 Catalano ..... G03B 21/10 352/139
3,978,547 A * 9/1976 Lawson ..... B08B 15/026 15/345
4,047,393 A * 9/1977 Hanson ..... F25B 39/04 62/428
4,102,017 A * 7/1978 Foerster ..... D01B 1/02 19/203
4,333,201 A * 6/1982 Rohner ..... B65H 54/702 15/301
4,344,295 A * 8/1982 Linstromberg ..... F25C 1/00 62/155
4,358,933 A * 11/1982 Horvay ..... F25D 21/008 62/155
4,370,863 A * 2/1983 Fisher ..... F24F 1/02 62/263
4,522,036 A * 6/1985 Van Gils ..... F25B 47/00 165/91
4,667,580 A * 5/1987 Wetzel ..... F24F 3/161 165/108
4,668,898 A * 5/1987 Harms ..... H02K 11/33 310/227
4,780,927 A * 11/1988 Clayton ..... B08B 15/026 15/345
4,839,529 A * 6/1989 Fruengel ..... G01N 15/06 250/574
4,865,401 A * 9/1989 Jacobson ..... B08B 15/026 312/1
4,928,348 A * 5/1990 Clayton ..... B08B 15/026 15/345
4,942,805 A * 7/1990 Hellwig ..... F24F 7/06 454/184
5,050,667 A * 9/1991 Berner ..... F24F 7/065 165/137
5,097,678 A * 3/1992 Aubuchon ..... F24F 1/50 150/154
5,211,028 A * 5/1993 Remo ..... F28G 1/02 165/94
5,226,285 A * 7/1993 Dankowski ..... F24F 1/0007 62/184
5,285,651 A * 2/1994 Marine ..... F28D 5/02 62/171
5,333,354 A * 8/1994 Takemoto ..... D04B 35/32 15/301
5,515,698 A * 5/1996 Sawazaki ..... B65H 49/16 15/301
6,050,101 A * 4/2000 Liu ..... F25B 39/04 62/280
6,110,246 A * 8/2000 Eubank ..... B01D 45/14 55/394
6,293,121 B1 * 9/2001 Labrador ..... B01D 61/10 62/304
6,295,696 B1 * 10/2001 Harmon ..... A47L 7/00 15/345
6,792,769 B2 * 9/2004 Trulaske, Sr. ..... F25B 47/00 165/232
6,793,715 B1 * 9/2004 Sandberg ..... B01D 46/10 55/486
6,823,684 B2 * 11/2004 Jensen ..... F24F 5/0035 62/171
7,024,878 B2 * 4/2006 Trulaske, Sr. ..... F25B 47/00 165/232
7,132,017 B2 * 11/2006 Laurence ..... B08B 3/02 134/30
7,477,027 B1 * 1/2009 Corbett ..... G06F 1/20 318/257
7,749,310 B2 * 7/2010 Lagerstedt ..... B04B 5/12 55/406
7,805,953 B2 * 10/2010 Jensen ..... F24F 1/027 62/305
8,182,611 B2 * 5/2012 Yoo ..... B08B 5/02 134/21
8,266,813 B2 * 9/2012 Grunert ..... D06F 58/206 34/595
8,590,100 B2 * 11/2013 Agorichas ..... B08B 5/02 15/345
9,222,695 B2 * 12/2015 Hasegawa ..... F24F 12/006
9,259,675 B2 * 2/2016 Roston ..... B01D 45/14
9,393,599 B2 * 7/2016 Seippel ..... B08B 3/02
9,638,444 B2 * 5/2017 Jokinen ..... F25B 39/04
9,803,780 B2 * 10/2017 Steinmann ..... F16L 5/02
10,081,038 B2 * 9/2018 Steinmann ..... B08B 5/02
2003/0150226 A1 * 8/2003 Jensen ..... F24F 5/0035 62/171
2004/0065107 A1 * 4/2004 Bas ..... B60H 3/0085 62/303
2006/0080982 A1 * 4/2006 Reichle ..... F25B 39/04 62/181
2007/0062211 A1 * 3/2007 Anderson ..... F25B 47/00 62/303
2008/0034776 A1 * 2/2008 Jensen ..... F24F 3/1603 62/305
2010/0236577 A1 * 9/2010 Yoo ..... B08B 5/02 134/21
2013/0160800 A1 * 6/2013 Steinmann ..... B08B 5/02 134/21
2015/0068710 A1 * 3/2015 Reid ..... F24F 3/1603 165/104.14
2016/0123643 A1 * 5/2016 Jokinen ..... F25B 39/04 62/177
2016/0305148 A1 * 10/2016 Poston ..... E04B 1/3211

OTHER PUBLICATIONS www.aeroconditioner.com [How ACBS Duffer from filters and canisters]. Aug. 12, 2015 [Air Cleaners Used for Feed Air]. Aug. 12, 2015.

* cited by examiner

USE OF AN AIR-CLEANING BLOWER TO KEEP CONDENSER COILS CLEAN

This application claims the benefit of the following U.S. Provisional Patent Application Nos. 62/390,318, filed Mar. 25, 2016 and 62/390,915, filed Apr. 14, 2016.

This invention is applicable to cooling appliances, in general, either those that operate on the conventional refrigerant compression-expansion process or those newer technologies that are thermoelectric in nature.

Most conventional plug-in cooling appliances, such as refrigerators, freezers, display merchandisers, and the like, that operate on the compression-expansion process have condenser coil units that vent the heat that has been extracted from the chamber intended to be cooled to the atmosphere. These coil units generally sit in an enclosure behind a panel (or grille) having vents that allow air to enter for the needed airflow over the coils for the dissipation of heat therefrom. The condensing unit typically has a fan that draws air across the coils to facilitate the needed heat transfer to insure the unit is operating efficiently.

It is well-known that severe clogging contamination of the coils, often over a short period of time measured in the space of only a few months, with dust and other debris will rob these coils of their ability to perform their essential heat exchange function. Various solutions have been suggested to solve the problems associated with such "dirty" condenser coils in refrigeration units. Condensing units have been modified to include automated brushing means (see U.S. Patent Publication No. 2007/0062211) or the direction of rotation of the fan has been designed to reverse periodically (see U.S. Pat. Nos. 6,792,769 and 7,024,878). Some persons have recommended placing filter media over the panel or grille containing the vents to trap dust and other debris before it enters the enclosure holding the coils. Other solutions have involved periodic cleaning of dirty coils with appropriate dust containment devices when compressed air is employed (see U.S. Pat. Nos. 6,295,696, 8,182,611 and 8,590,100 and U.S. Patent Publication No. 2013/0160800, which covers the commercially available COILPOD dust containment bag, which is one preferred dust containment product).

The present invention is directed to a novel way of largely preventing dust contamination of the coils in the first place and is illustrated in the Drawings wherein.

Figure 1:
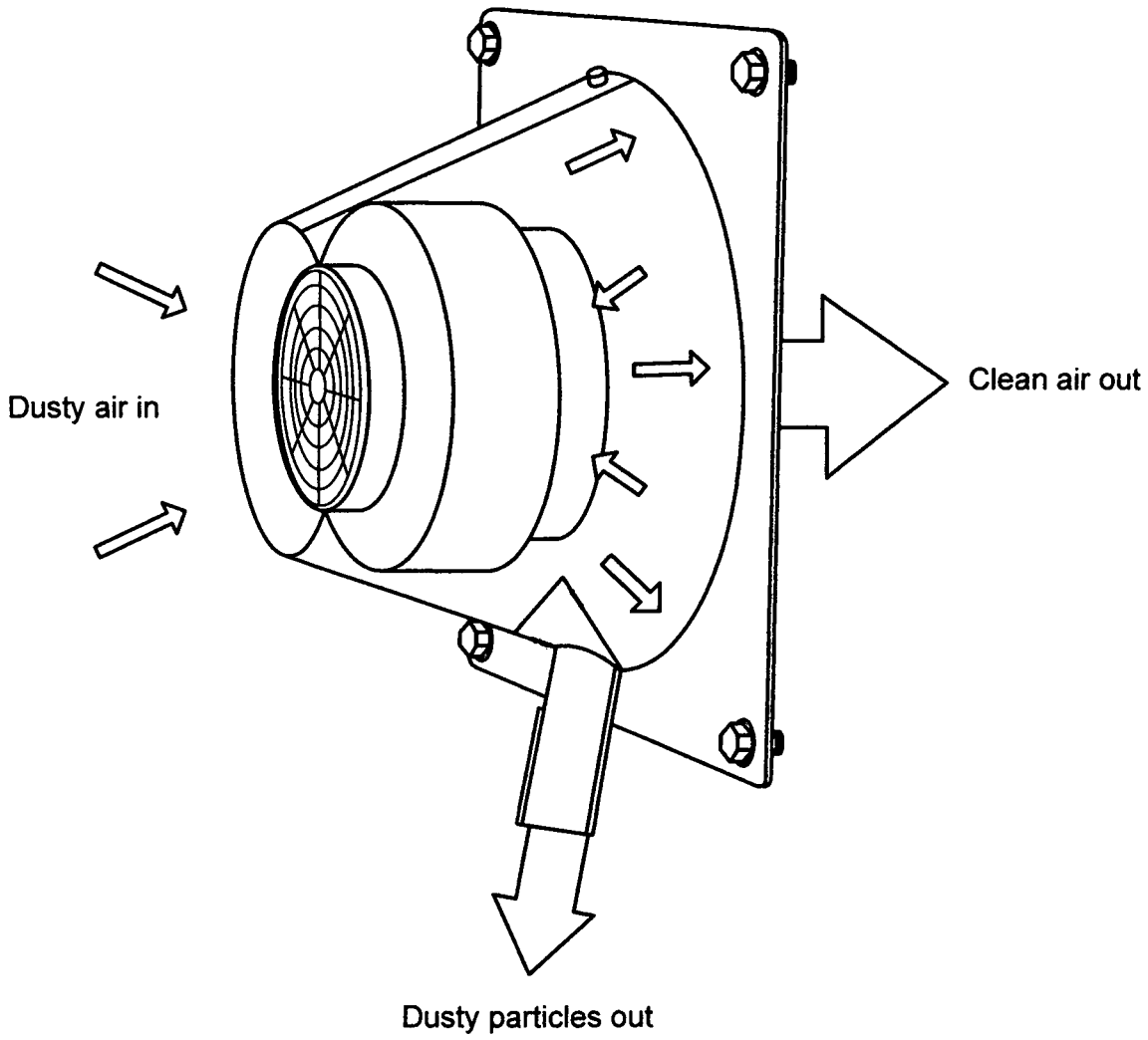
(PRIOR ART) FIG. 1
FIG. 1 is a perspective view of the air cleaning blower which forms an essential component in the practice of the present invention.
Figure 2:
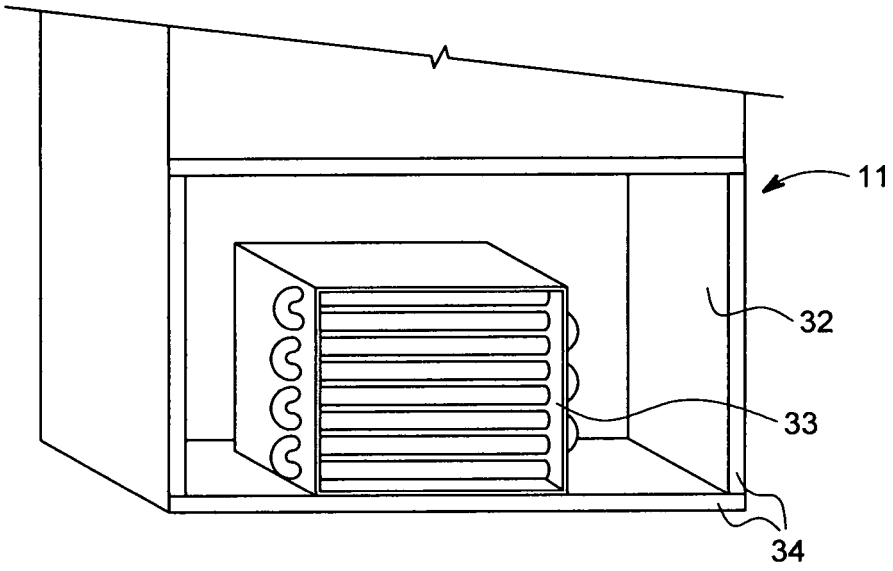
FIG. 2 is a perspective view of the front of a commercial-type refrigeration unit with the cover over the enclosure holding the unit's condenser coil unit removed.

The instant invention involves replacing the conventional vented cover now used with a non-vented cover that also comprises an air-cleaning blower, which is shown in FIG. 1. This blower is placed over an orifice in the cover shown in FIG. 3. The orifice is in communication with the interior of the enclosure holding the condenser coils. The cover shown in FIG. 3 would be appropriately dimensioned to fit over the opening of the enclosure 32, depicted in FIG. 2, which holds the condenser coil unit 33 by affixation to surfaces 34 of the refrigeration unit 11.

One preferred conically-shaped air-cleaning blower unit, as depicted in FIG. 1, is described in U.S. Pat. No. 9,259,675, which is incorporated herein by reference. It is commercially available from Aero Conditioner LLC, Brooklyn, N.Y. 11205 (whose domain is aeroconditioner.com). This apparatus intakes air that is contaminated with all types of dust, debris, other particulates, and so forth and induces centripetal forces thereon to cause such contaminants to separate and be expelled from a different outlet located on the blower's periphery. This action is responsible for introduction of the cleansed air stream into the enclosure holding the condenser coils. The blower apparatus comprises an inlet, housing, impeller, and at least one clean air outlet and one particulate outlet.

The use of this air-cleaning blower unit can obviate the need for a fan assembly, as is conventional, in condensing units now in operation or it could be used in conjunction with such fan depending on the blowing power of the selected air-cleaning blower. It is well within the skill in the art to calibrate the needed blowing power of the blower and appropriately connect its electrical wiring to the condensing unit's fan power source(s) within the enclosure. When the refrigeration unit cycles on, the blower, either with or without the conventional condensing fan now commonly used, can cycle on as well to supply an air flow to promote coil heat transfer.

Figure 3:
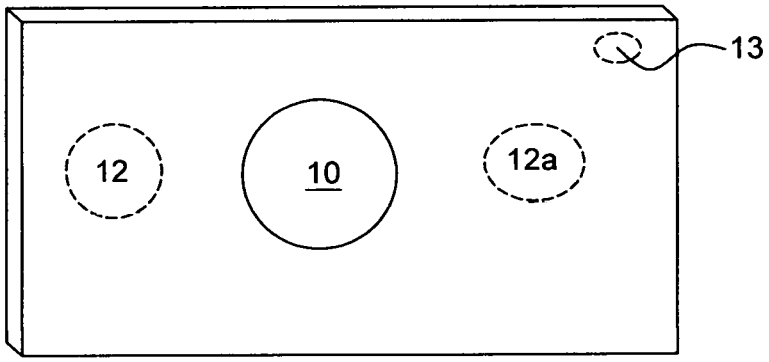
FIG. 3 is a perspective view of the type of novel cover that is employed by the present invention to close the opening to the enclosure that is illustrated in FIG. 2.

FIG. 3 shows an alternative cover plate containing the previously described air-cleaning blower 10, along with optional ports 12 and 12*a* (which would be covered in normal operation of the refrigeration unit to preserve the vent-less character of the cover). These ports are analogous to the ports contained in the dust containment bag described in U.S. Patent Publication No. 2013/0160800, which is commercially available under the trademark COILPOD. Such ports allow for coil cleaning, without removal of the cover plate, with a combination of sources of compressed air and vacuum, respectively placed in each of the ports once those ports are opened. If desired, an appropriate temperature indicator 13 can also be included, which can signal the presence of dirty coils, either visually or wirelessly. This indicator is connected to the condenser coils as described in U.S. Patent Publication No. 2015/0176932.

In order that the entire unit functions with the lowest electric energy possible, a preferred embodiment utilizes a special class of electric motor for both the fan in the condensing unit, if that is not deactivated, as well as in the air-cleaning blower. Rather than being either an induction (or shaded-pole) motor or the more recently developed electronically commutated motor, the preferred motor is the type of synchronous motor developed by and commercially available from QM Power, Inc. and designated the Q-SYNC Smart Synchronous Motor. This type motor, unlike an electronically commutated motor, does not require continual conversion between AC and DC power throughout its use to operate. The preferred motor's electronics get the motor to its targeted speed and then efficiently shift the motor to AC power supplied directly from the grid. Further details on this type of motor can be found in the following patent documents, which are incorporated herein by reference: U.S. Pat. Nos. 7,898,135; 8,810,084; 9,231,459; and 9,300,237 and U.S. Patent Publication No. 2016/0094113.

The other type of refrigeration apparatus that can be improved by the present invention operates thermo-electrically where a voltage of constant polarity is applied to a junction between two dissimilar electrical semiconductors where the negative one becomes cooler and the positive one hotter. A heat sink is used to dissipate the thermal energy from the positive one into the external environment as is well known to persons in the art. These heat sinks tend to collect dust and debris in an analogous manner to the condenser coils in the previously described compression-expansion refrigeration units. The enclosure holding such heat sink heat dissipation structure(s) will benefit in an analogous manner to the more conventional systems if the enclosure is closed off except for the previously described air cleaning blower being the source of air that is imported into the enclosure to assist in cooling the heat sink.

This invention also involves a new business method: (1) either retrofit or new unit manufacture of refrigeration apparatus, either non-residential or residential, employing the air-cleaning blower installation previously described; (2) coupled with an ongoing preventative maintenance program where the condenser coils (or heat sink) are cleaned, if needed, after being placed in service with a compressed air stream (e.g., compressed air, dry steam, or possibly liquid solvent stream) and vacuum using the previously COILPOD dust containment method and apparatus.

I claim:

1. In a refrigeration apparatus including an enclosure and condenser coils located within the enclosure, the condenser coils being prone to become dirty over time as the condenser coils come in contact with an incoming air stream intended to promote heat transfer across the condenser coils, wherein the improvement comprises:

a cover plate dimensioned to fit over an opening to the enclosure;

an orifice in the cover plate, the orifice in communication with the interior of the enclosure;

an air-cleaning blower apparatus operably positioned over the orifice and upstream of the condenser coils such that the incoming air stream enters the enclosure via the air-cleaning blower apparatus, thus allowing said air-cleaning blower apparatus to remove contaminants from the incoming air stream before the incoming air stream contacts the condenser coils.

2. The apparatus as claimed in claim 1, wherein the cover plate further comprises ports to allow the introduction of compressed air into the enclosure and/or to allow the application of a vacuum to the enclosure, respectively, thus allowing the condenser coils to be cleaned when they become dirty.

3. The apparatus as claimed in claim 1, wherein the cover plate further comprises an indicator to signal the need for cleaning the condenser coils should the condenser coils become dirty.

4. The apparatus as claimed in claim 1, wherein the cover plate further comprises ports to allow the introduction of compressed air into the enclosure and/or to allow the application of a vacuum to the enclosure, respectively, thus allowing the condenser coils to be cleaned when they become dirty, as well as further comprising an indicator to signal the need for cleaning the condenser coils should the condenser coils become dirty.

5. The apparatus as claimed in claim 2, wherein the cover plate further comprises an indicator to signal the need for cleaning the condenser coils should the condenser coils become dirty.

* * * * *